US006848856B2

(12) United States Patent
Johnson

(10) Patent No.: US 6,848,856 B2
(45) Date of Patent: Feb. 1, 2005

(54) RECTRACTABLE PYLON ARRANGEMENT

(75) Inventor: Dwight David Johnson, West Somerville, MA (US)

(73) Assignee: National Sign & Signal Co., Battle Creek, MI (US)

( * ) Notice: Subject to any disclaimer, the term of this patent is extended or adjusted under 35 U.S.C. 154(b) by 0 days.

(21) Appl. No.: 10/645,315

(22) Filed: Aug. 20, 2003

(65) Prior Publication Data

US 2004/0151542 A1 Aug. 5, 2004

Related U.S. Application Data

(63) Continuation of application No. 09/631,573, filed on Aug. 4, 2000, now Pat. No. 6,626,606.

(51) Int. Cl.[7] ..... E06B 11/00

(52) U.S. Cl. ..... 404/6; 404/10; 49/49; 49/131

(58) Field of Search ..... 404/6, 9, 10; 49/49, 49/131

(56) References Cited

U.S. PATENT DOCUMENTS

| | | | | |
|---|---|---|---|---|
| 3,272,021 A | | 9/1966 | Weber | |
| 3,530,775 A | | 9/1970 | Bowersox | |
| 3,660,935 A | * | 5/1972 | Boots | 49/35 |
| 4,411,166 A | | 10/1983 | Marcovici | |
| 4,531,747 A | * | 7/1985 | Miura | 277/134 |
| 4,576,508 A | | 3/1986 | Dickinson | |
| 4,666,331 A | * | 5/1987 | Riley | 404/6 |
| 4,715,742 A | * | 12/1987 | Dickinson | 404/6 |
| 4,919,563 A | * | 4/1990 | Stice | 404/6 |
| 4,947,698 A | | 8/1990 | Dodds et al. | |
| 5,365,694 A | | 11/1994 | Macaluso | |
| 5,425,595 A | | 6/1995 | Roper | |
| 5,462,384 A | | 10/1995 | Arlandis | |
| 5,474,017 A | * | 12/1995 | Mohebbi et al. | 116/209 |
| 5,499,887 A | | 3/1996 | Verra | |
| 5,645,283 A | * | 7/1997 | Drucktenhengst et al. | 277/153 |
| 5,819,471 A | * | 10/1998 | Koerber | 49/49 |
| 5,975,792 A | | 11/1999 | Goeken et al. | |
| 6,065,900 A | * | 5/2000 | Reale | 404/6 |

FOREIGN PATENT DOCUMENTS

| | | | |
|---|---|---|---|
| FR | 2 650 009 | | 1/1991 |
| FR | 2 659 995 | * | 9/1991 |
| WO | WO 80/02576 | | 11/1980 |

OTHER PUBLICATIONS

The Retractor ™ 'Automatic Retractable Lane Delineator', Safe–Hit Corporation, 2 pages, undated.* www.safe–hit.com/products/retractor.asp, copyright 2001.*

International Search Report mailed May 27, 2002, as issued by the European Patent Office in PCT International Application No. PCT/US01/41552, filed Aug. 3, 2001 (5 pages).

Invitation to Pay Additional Fees and Partial International Search Report dated Feb. 22, 2002, as issued by the European Patent Office in PCT International Application No. PCT/US01/41552, filed Aug. 3, 2001 (4 pages).

Safe–Hit Corporation, One–page advertising brochure for "The Retractor", Copyright 1999.

Zero–Max/Helland Motion Control Products, Warranty Statement for Roh'lix Actuator, copyright 1992, 1 page.

* cited by examiner

*Primary Examiner*—Gary S. Hartmann

(74) *Attorney, Agent, or Firm*—Flynn, Thiel, Boutell & Tanis, P.C.

(57) ABSTRACT

A pylon or barrier arrangement which is recessed into the ground or other surface and includes a post-like pylon which is movable between an extended position for control of vehicular or pedestrian traffic, and a retracted position beneath the ground. Movement of the pylon is achieved by a linear-type drive mechanism which acts as a clutch by decoupling from an upright and rotatable smooth drive shaft during abrupt downward driving of the pylon to avoid damage to the internal components of the arrangement. A sealing arrangement is provided for preventing the entry of debris into the interior of the pylon arrangement, and a heating unit is provided for preventing seizure of the arrangement during harsh weather conditions.

17 Claims, 6 Drawing Sheets

RECTRACTABLE PYLON ARRANGEMENT

This is a continuation of Ser. No. 09/631,573, filed Aug. 4, 2000 U.S. Pat. No. 6,626,606.

FIELD OF THE INVENTION

This invention generally relates to a pylon or barrier arrangement which is recessed into the ground or other surface, including a post-like pylon which is raised into an extended position for control of vehicular or pedestrian traffic.

BACKGROUND OF THE INVENTION

The control of vehicular traffic often requires that certain lanes be closed to traffic and that traffic be temporarily be redirected to other lanes to accommodate variances in traffic flow, or as a result of repair work. It is also often necessary or desirable to control the ingress and egress of pedestrians in certain public areas, such as in amusement parks, college campuses, and tourist areas. This type of traffic control is often achieved by manually positioning freestanding markers, such as upright cones or drums, at desired locations and then removing or shifting same as necessary. This solution is time consuming, and in the situation where cones are placed directly on roadways to control or restrict vehicular traffic, poses a hazard to workers who must necessarily enter the roadway where vehicles are often traveling at high speeds.

As such, various pop-up traffic control devices have been developed which include a cartridge or housing embedded beneath the ground or roadway surface and a pylon or bollard which is housed within the below-ground cartridge when not in use. The pylon is remotely activated to raise same into an uppermost position for controlling or restricting traffic. A number of such traffic control devices are installed in side-by-side spaced relation with one another along a roadway or other area to provide traffic guidance. For the purpose of raising and lowering the pylon, many of these conventional devices include a rotatably driven threaded shaft which is mounted within the embedded lower cartridge. The shaft engages with a screw nut which is fixed to the pylon so that the nut and pylon traverse up or down on the shaft depending upon the rotational direction thereof. Examples of such an arrangement are disclosed in U.S. Pat. No. 5,425,595, and French Patent No. 2650-009.

The primary disadvantage of devices utilizing a screw-type mechanism to actuate the pylon is end-loading. More specifically, abrupt axial end-loading of the pylon occurs when the pylon is driven downwardly, for example by a vehicle tire, when the pylon is rising from the roadway surface. This downward driving of the pylon and nut often results in a stripped nut, or more significantly, the downward driving of the shaft itself which can cause damage to the motor and/or other internal components mounted within the lower area of the cartridge, such as the control board. These types of arrangements also include less than desirable sealing capabilities, which can result in the accumulation of dirt and grit on the threaded shaft and thus an abraded or damaged screw nut and/or shaft.

Other conventional pop-up traffic control devices utilize pneumatic devices to raise and lower the pylon. However, these arrangements often require close tolerances within their construction to prevent leakage, and involve increased costs associated with installation of appropriate pneumatic lines in the roadway.

With traffic control devices which are permanently installed in the roadway, exposure of the device to freezing temperatures can also present problems, such as ice formation adjacent the top of the cartridge which can restrict movement of the pylon. Conventional solutions to this problem included providing a heater disposed exteriorly of the pylon so as to heat the top cover or flange located adjacent the roadway surface to melt the ice. However, since the top cover is typically of significant width and thickness dimensions, a high-wattage heater and considerable warm-up time are necessary. In addition, angled road grades often create complications with existing devices, wherein the interference between the top flange or plate and the pylon can jam or stall the motor.

The present invention relates to a retractable-type barrier or pylon arrangement including an extendible and retractable pylon or cylinder which is actuated by a drive mechanism capable of compensating for an abrupt axial downward movement of the pylon, thus avoiding damage to the drive mechanism itself and/or other internal components of the system. The invention also incorporates an improved sealing arrangement which minimizes the amount of water and debris entering the arrangement from the surface, and an improved heating system which requires less energy.

More particularly, one aspect of the invention relates to a barrier arrangement including a generally tubular housing mounted within the ground so that an upper end thereof is generally flush with the ground surface. A post is disposed within the housing and is telescopingly movable relative thereto between an uppermost position wherein the post extends upwardly from the upper end of the housing and above the ground surface and a lowermost position wherein the post is disposed substantially completely within the housing and beneath the ground surface. A drive mechanism moves the post between the uppermost and lowermost positions, which drive mechanism includes a rotatable drive shaft having a smooth outer surface, and a block-like member disposed in clamping engagement with the smooth outer surface and non-movably fixed to the post. Rotation of the drive shaft causes displacement of the block-like member and the post relative to and along the drive shaft to move the post into one of the uppermost and lowermost positions.

Another aspect of the invention relates to a retractable pylon arrangement including a generally upright cartridge embedded within an opening in the ground so that an uppermost end thereof is substantially level with the ground surface. A pylon is disposed in a telescoping manner within the housing and is movable between an extended position wherein the pylon is cantilevered upwardly from the ground and a retracted position wherein the pylon is positioned within the cartridge and beneath the ground surface. A remotely-controlled drive mechanism moves the post between the extended and retracted positions, and an annular flange closes off the uppermost end of the cartridge. The flange has an inner terminal periphery disposed in surrounding relation with the pylon which defines an opening to permit movement of the pylon between the extended and retracted positions. A flexible annular seal member is mounted on the inner periphery of the flange and extends inwardly so as to maintain contact with an outer surface the pylon during movement thereof.

A further aspect of the invention relates to a pylon arrangement for controlling vehicular traffic including a generally hollow housing structure fixed within the ground in a generally upright manner, and an elongate pylon mounted for movement into the housing structure into a retracted storage position and for movement out of the housing structure into an extended position for controlling traffic. A heating unit is disposed within the pylon which when energized effectively heats an outer wall of the pylon and prevents seizure of the pylon due to ice build-up at least adjacent the ground surface.

Other objects and advantages of the invention will be apparent to persons familiar with structures of this general type upon reading the following specification and inspecting the accompanying drawings.

Figure 1:
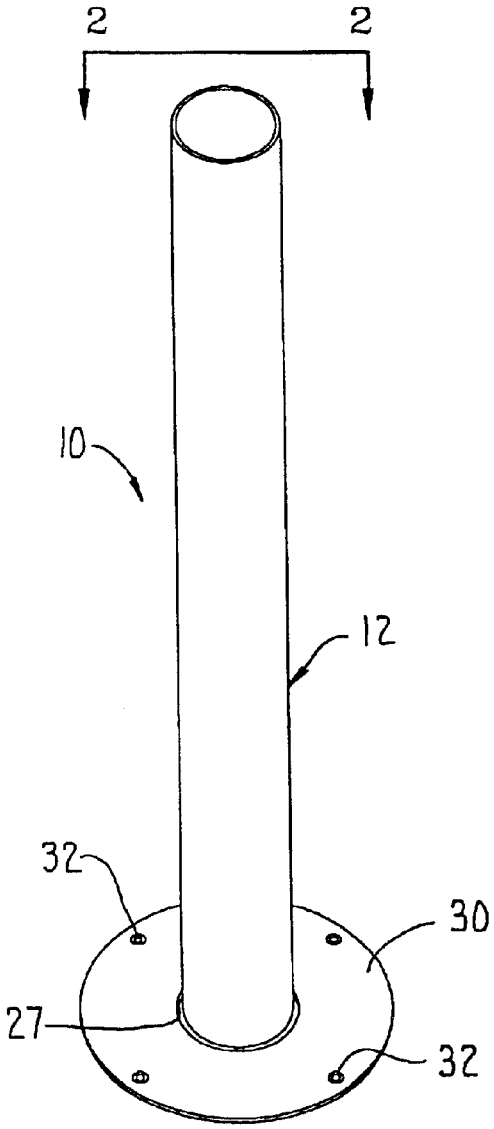
FIG. 1 is a perspective view of the retractable pylon arrangement according to the invention, with the pylon or post in the fully extended or up position.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
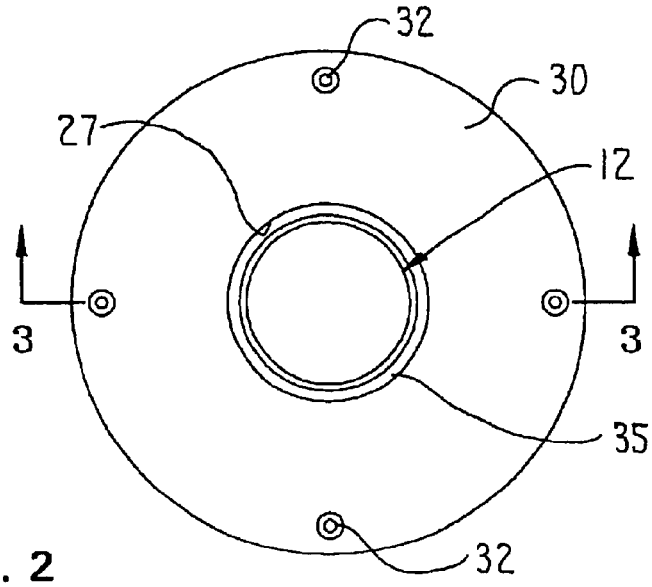
FIG. 2 is an enlarged overhead view of the arrangement as seen generally along line 2—2 in FIG. 1.
Figure 3:
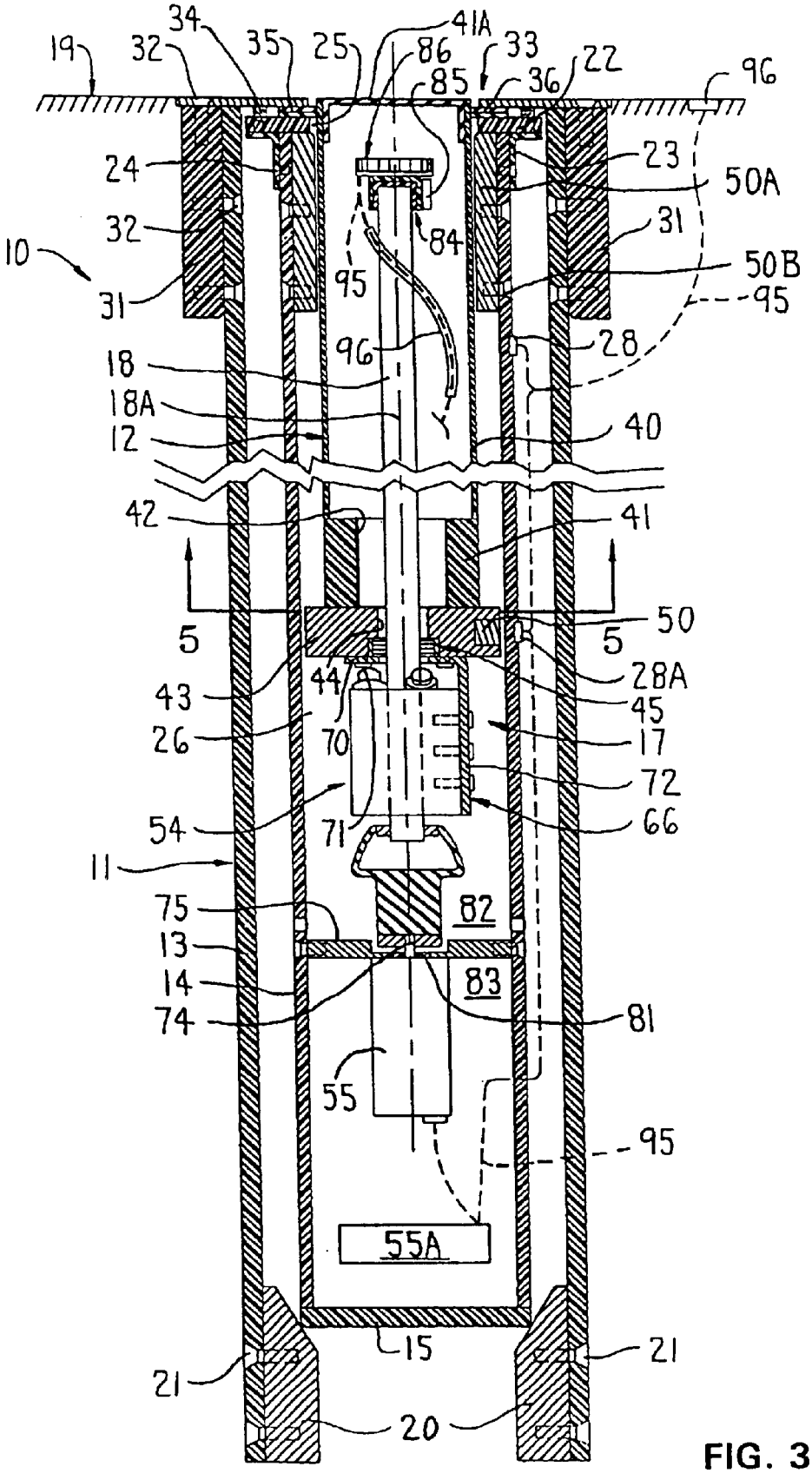
FIG. 3 is an enlarged fragmentary cross-sectional view taken generally along line 3—3 in FIG. 2, with the pylon in the fully retracted or down position.

Referring to the drawings, and particularly FIGS. 1—3, a barrier or pylon arrangement 10 is illustrated according to the present invention. The arrangement 10 generally includes a rigid tubular outer cartridge or housing 11, and a post or pylon 12 which is telescopingly arranged within outer cartridge 11. The cartridge 11 generally has the shape of an elongate cylinder, and is embedded substantially entirely within the ground in a generally upright manner so that the uppermost end thereof is substantially flush with the road or ground surface 19. The pylon 12 is also elongate and generally cylindrical, and is movable between an extended position (FIGS. 1 and 4) wherein the pylon 12 projects upwardly from the ground, and a retracted position (FIG. 3) wherein the pylon 12 is housed substantially completely within the cartridge 11. Movement of the pylon 12 is achieved via a drive mechanism 17 including an elongate, vertically oriented and rotatable drive shaft 1B having a smooth outer surface and defining an axis of rotation 18A. Drive shaft 18 is rotatably but axially stationarily mounted within cartridge 11.

Figure 4:
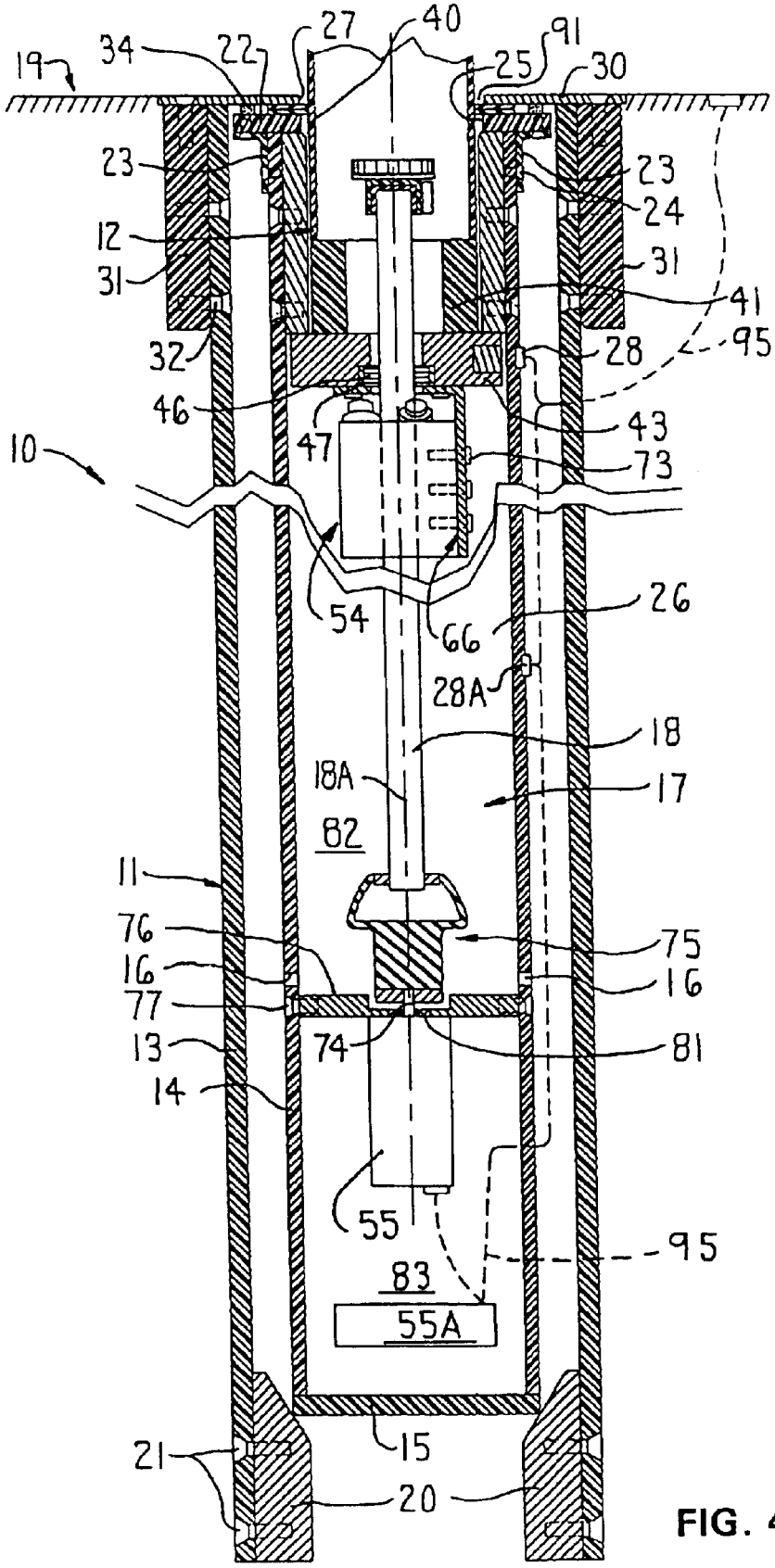
FIG. 4 is a view similar to FIG. 3, but with the pylon in the fully extended or up position.

As shown in FIGS. 3 and 4, cartridge 11 includes a rigid outer tube 13 and a rigid inner tube 14 which is disposed generally concentrically within outer tube 13. In the illustrated embodiment, outer tube 13 is open at the lower end thereof, and inner tube 14 is closed by an end wall or cap 15. A plurality of plate-like support blocks 20 are fixed to the inner surface of outer tube 13 adjacent the lower end thereof via fasteners 21, which support blocks 20 provide vertical support for the inner tube 13. Additional spacer blocks (not shown) may be provided between the outer and inner tubes 13 and 14 adjacent the upper ends thereof. Outer and inner tubes 13 and 14 may be constructed of rigid plastic, such as PVC pipe.

The vertical length of inner tube 14 is slightly less than the vertical length of outer tube 13, so that the cap 15 of inner tube 14 is spaced vertically upwardly from the lower end of outer tube 13, and the upper end of inner tube 14 is spaced a short distance downwardly from the upper terminal end of outer tube 13. A lower annular plate-like flange 22 is fixed to the uppermost end of inner tube 14 by a plurality of angled or corner-shaped support brackets 23 which are fixed to flange 22 and tube 14 via fasteners 24. The inner edge of flange 22 defines a generally centrally oriented opening 25 which defines an upper access opening into an elongate interior chamber 26 defined within inner tube 14. Further, a pair of switches 28 and 28A are mounted on the outer surface of inner tube 14. In the preferred embodiment, the switches 28 and 28A are conventional Hall-effect switches or sensors and are mounted in vertically spaced relation from one another on tube 14 for a purpose as discussed below. Other types of sensors or switches may be utilized with the invention, such as conventional limit switches.

An upper annular plate-like flange or cover 30 (preferably of metal, such as stainless steel) is fixed to the uppermost end of outer tube 13 and is spaced slightly vertically above lower flange 22. The upper flange 30 is fastened to the outer tube 13 by a plurality of fastening blocks 31 which are spaced from one another about the outer surface of the uppermost end of tube 13 and fixed thereat by fasteners 32. Additional fasteners 32 extend downwardly through the upper surface of flange 30 and into the top end of the respective blocks 31. Upper flange 30 defines a generally centrally oriented opening 27 which is aligned with opening 25 of lower flange 22.

A sealing arrangement 33 is provided at the uppermost end of cartridge 11. Sealing arrangement 33 includes a pair of flexible and ring-like seals 35 and 36 which are vertically stacked on one another and sandwiched between the upper and lower surfaces of the respective flanges 22 and 30 adjacent the inner peripheries thereof. In the illustrated embodiment, seal rings 35 and 36 are constructed of silicone rubber, although other flexible sealing materials may be utilized in accordance with the present invention. The inner peripheries of the seal rings 35 and 36 extend horizontally beyond the inner peripheral edges of flanges 22 and 30 which define the respective openings 25 and 27 and contact the outer surface of pylon 12 at all times so as to prevent the entry of water and/or debris into the interior of cartridge 11. In one embodiment, one of the seals 35, 36 (i.e. the lower seal) is somewhat more rigid than the opposed seal, so as to provide support thereto and avoid over-flexing thereof. Sealing arrangement 33 optionally also includes a ring-like strip 34 positioned between the upper and lower surfaces of the respective flanges 22 and 30, generally adjacent the outer periphery of lower flange 22. In the illustrated embodiment, strip 30 is of a foam material, and is fixed to the upper and lower flanges 22 and 30 via adhesive.

The pylon 12 is mounted within the interior chamber 26 of inner tube 14, and includes an elongate and generally cylindrical hollow tube 40 having a lower terminal end fixedly mounted on a rigid base 41 and an open end closed off with a cap 41A. Base 41 is annular in configuration so as to define a centrally oriented through-hole 42. Base 41 is fixedly mounted atop a ring-like hub 43 which defines an opening 44 therethrough which is generally aligned with through-hole 42. Tube 40, hub 43 and base 41 are dimensioned so that the outer diameters thereof are smaller than the inner diameter of inner tube 14 to permit telescoping movement of pylon 12 therewithin. An annular wiper or brush 45 is mounted within hub 43 and is recessed upwardly and into a lower surface thereof. In the illustrated embodiment, brush 45 includes a plurality of bristles 46 having outer ends which are fixed to an outer ring 47 and extend radially inwardly therefrom so that the free inner ends of the bristles contact the outer surface of the drive shaft 18. As shown in FIG. 3, the drive shaft 18 extends upwardly through brush 45, opening 44 of hub 43, through-hole 42 of base 41 and into the hollow interior of tube 40. Further, a permanent magnet 50 is embedded within hub 43 so as to be generally flush with an outer periphery thereof. As discussed further below, sensors 28, 28A cooperate with magnet 50 to sense and limit the upper and lower extension of pylon 12.

A plurality of stop blocks 50A are mounted to the inner surface of inner tube 14 generally beneath flange 22 via fasteners 50B. Stop blocks 50A serve to limit the upward extension of pylon 12 from cartridge 11 through abutting contact with hub 43 (FIG. 4).

Figure 5:
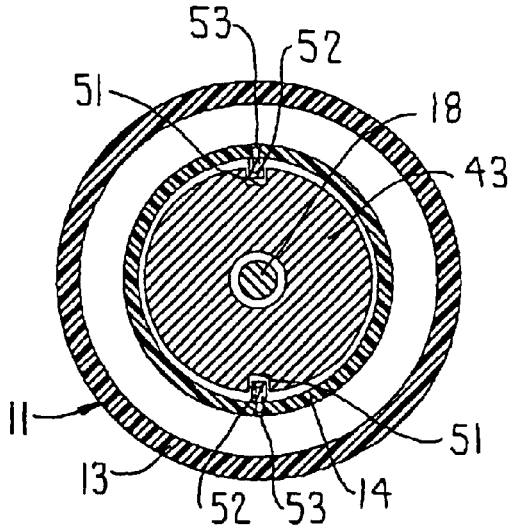
FIG. 5 is an enlarged cross-sectional view taken generally along line 5—5 in FIG. 3.

With reference to FIG. 5, hub 43 defines therein two diametrically opposed and vertically elongate guide slots 51 which open sidewardly from the outer periphery thereof. A pair of vertically elongate guide bars 52, which in the illustrated embodiment are constructed of aluminum, are fixed to the inner surface of inner tube 14 via fasteners 53 in diametrically opposed locations (and so as to be circumferentially offset from the respective stop blocks 50A) and engage within the respective slots 51. Guide bars 52 have a cross-sectional configuration similar to the cross-sectional configuration of the respective slots 51. Guide bars 52 extend along a substantial portion of the vertical extent of inner tube 14, and the engagement of the guide bars 52 within the respective slots 51 guides the pylon 12 during raising and lowering thereof relative to cartridge 11 and prevents rotation of pylon 12 relative thereto.

Figure 6:
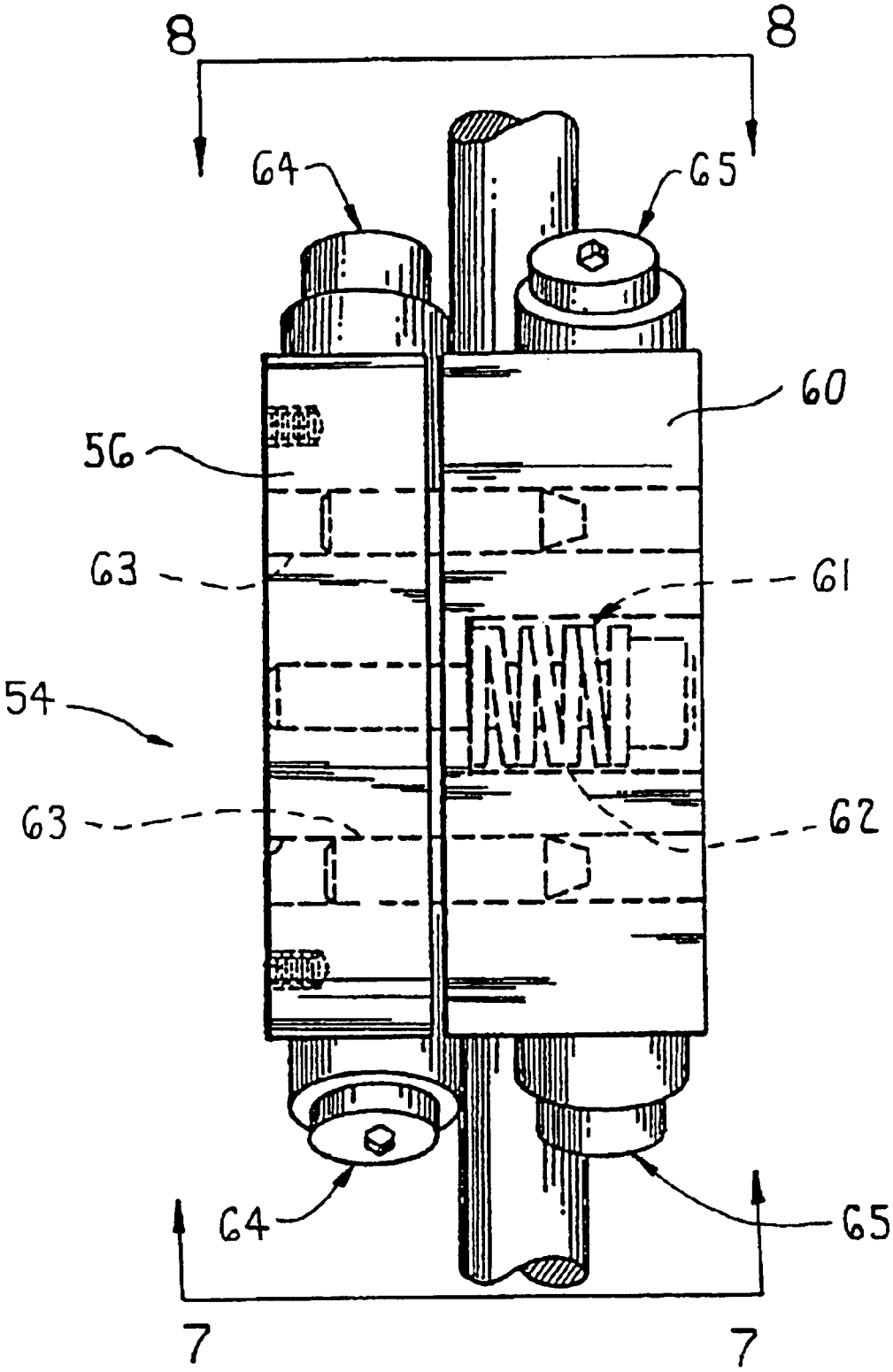
FIG. 6 is an enlarged fragmentary view of the linear drive or actuator and drive shaft.
Figure 7:
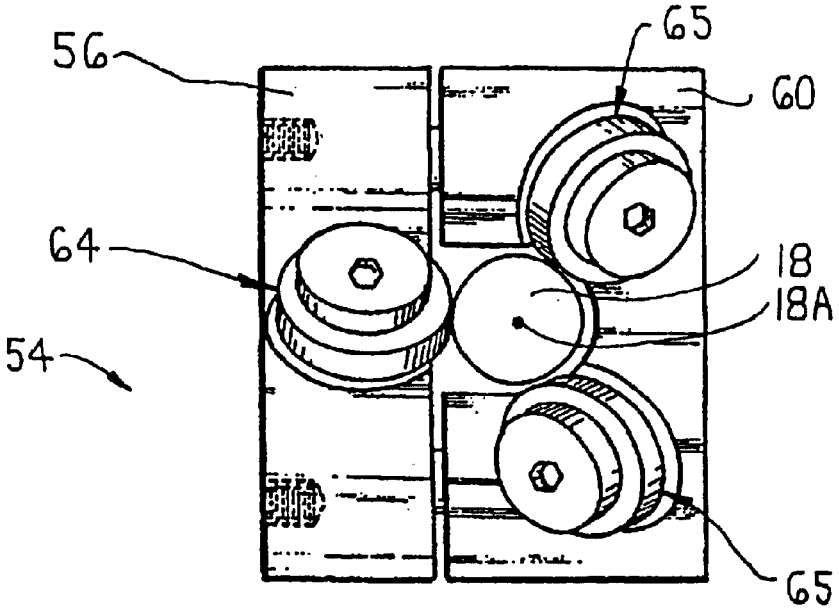
FIG. 7 is an end view of the linear drive or actuator and drive shaft as seen generally along line 7—7 in FIG. 6.
Figure 8:
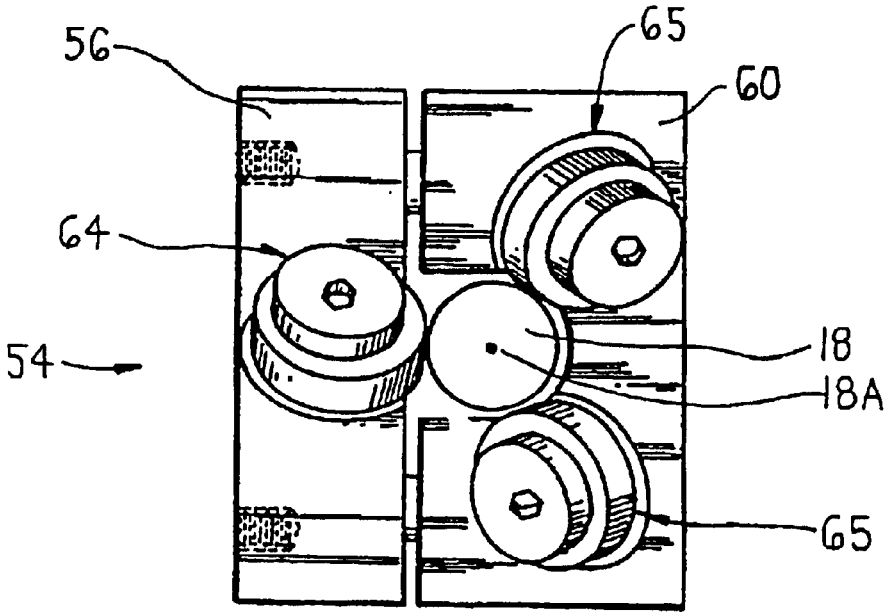
FIG. 8 is an end view of the actuator and drive shaft as seen generally along line 8—8 in FIG. 6.

With reference to FIGS. 3 and 6–8, drive mechanism 17 in addition to drive shaft 1B includes a linear drive or actuator 54 which engages the smooth outer surface of shaft 18 and translates rotary motion thereof into linear motion, and an electric motor 55 which drives shaft 18. The linear drive 54 illustrated in FIGS. 6–8 is disclosed in U.S. Pat. No. 4,947,698 which is hereby incorporated by reference herein. Accordingly, only a brief description of drive 54 will be provided.

Drive 54 includes a mounting block 56 and an adjusting block 60 which are joined together in opposed relation by a pair of fasteners 61 (only one of which is shown) so as to sandwich drive shaft 18 therebetween. The fasteners 61 are mounted so that the respective heads or adjustment ends are exposed adjacent the outer side surface of adjusting block 60 and the inner threaded shaft ends are engaged within a threaded bore of the opposite mounting block 56. Fasteners 61 each mount thereon a spring 62 so that the clamping force of the respective blocks 56 and 60 is adjustable by manipulating the respective fasteners 61 to compress the springs 62. The blocks 56 and 60 are further aligned with one another by a pair of locator pins 63 mounted within the respective blocks 56, 60. The mounting block 56 mounts a roller bearing 64 on each axial end thereof, and adjusting block 60 mounts two roller bearings 65 on each axial end thereof. These roller bearings 64 and 65, as best shown in FIGS. 7 and 8, are oriented at an angle relative to the axis 18A of the drive shaft 18 so that the blocks 56 and 60 are longitudinally displaced along drive shaft 18 upon rotation thereof.

Linear drive 54 is mounted to hub 43 by a corner-shaped bracket 66 having an upper horizontal flange 70 which is fixed to the lower surface of hub 43 with fasteners 71 and defines an opening 71A therein for shaft 18, and a lower vertical flange 72 which depends downwardly from an end edge of flange 70 and is fixed to one of the blocks 56, 60 with fasteners 73.

The lowermost terminal end of drive shaft 18 is nonrotatably connected to an output shaft 74 of motor 55 through a coupling 75 which is constructed of a flexible material, for example rubber, so as to compensate for any misalignment between the respective shafts 18 and 74. The drive shaft 18 is further supported in the lateral direction via the clamping engagement of blocks 56, 60 thereon and the connection of blocks 56, 60 to hub 43, which hub 43 in turn engages guide bars 52. Motor 55 is mounted within the lower end of inner tube 14 by a generally horizontally oriented and rigid mounting plate 76 which is fixed to the inner surface of inner tube 14 with fasteners 77. Mounting plate 76 defines therein an opening through which motor shaft 74 extends for connection to flexible coupling 75. An annular lip seal 81 is mounted within opening 80 and is spring-loaded so as to maintain constant pressure between the seal and the output shaft 74 of motor 55. One type of spring-loaded seal which may be utilized is commonly known as an oil seal typically used as a shaft seal in various types of pump mechanisms. Alternatively, a rubber gasket may be provided between the top of motor 55 and the lower surface of mounting plate 76 to seal output shaft 74.

The mounting plate 76 divides the interior chamber 26 of inner tube 14 into upper and lower compartments 82 and 83. The upper compartment 82 thus houses the pylon 12, drive 54 and shaft 18, while the lower compartment 83 houses the motor 55 and a control board 55A (shown schematically only). Seal 81 thus prevents water from entering the lower compartment 83, and other potential leak points into the lower compartment 83 are sealed with a silicone sealant or other appropriate sealant. As entry of some water and debris into the inner tube 14 is essentially inevitable with a below-ground arrangement of the type disclosed herein, drain holes 16 in the wall of inner tube 14 allow escape of fluid from upper compartment 82.

Referring to FIG. 3, the upper end of drive shaft 18 mounts thereon a thrust bearing 84. A heating unit 85 is mounted within the interior of pylon tube 40 on the side of the thrust bearing 84. In the illustrated embodiment, the heating unit 85 is a low-wattage, rubber encapsulated, 24 volt heater. Further, a lighting arrangement 86 is provided within pylon tube 40. The lighting arrangement 86 includes a LED light cluster mounted to the thrust bearing 84 just below the roadway surface 19 so as to illuminate the entire pylon tube 40 when in the upwardly extended position (FIGS. 1 and 4). The bearing 84 in the illustrated embodiment is lined with Teflon to permit low-friction rotation of the shaft 18 relative to bearing 84, so that heating unit 85 and lighting arrangement 86 are maintained essentially stationary.

The pylon arrangement 10 in the illustrated embodiment is controlled from a remote location with an electronic control panel (not shown) which communicates with the control board 55A either wirelessly via radio signals or by means of a direct electrical connection.

The motor 55, control board 55A, heating unit 85, lighting arrangement 86 are electrically connected via wiring 95 (shown in dotted lines) to a power pack or module 96 (shown schematically) mounted adjacent the ground surface 19 and connected to a power source. Wiring 95 leading to lighting arrangement 86 and heating unit 85 may be encased within flexible tubing 96 to protect the wiring and to minimize wear thereof due to movement of the pylon 12. This wiring 95 within tube 40 may be routed to the exterior of tube 40 by extending the wiring downwardly through opening 42 in base 41, through an orifice (not shown) in hub 43 and then outwardly through an opening (not shown) in inner tube 14. The wiring 95 within lower chamber 83 is also routed through an opening (not shown) through the wall of inner tube 14. Likewise, wiring 95 routed between inner and outer tubes 13 and 14 is routed through an opening (not shown) through the wall of outer tube 13 to power pack 96. It will be appreciated that the openings in inner and outer tubes 14 and 13 for routing wiring 95 are sealed around the respective wires to prevent entry of water or other contaminants. Communication cabling may also be routed through power pack 96 to control board 55A. The arrangement 10 is also typically connected to other pylon arrangements 10 via electrical and communication cabling.

As mentioned above, the cartridge 11 is mounted below ground level by embedding same in a pre-formed hole. If desirable or necessary, gravel or other material, such as concrete, may be used as filler around the outer surface of outer tube 13 to stably position the cartridge 11 in the ground. The cartridge 11 is mounted within the ground at a depth so that the top flange or cover 30 is substantially flush with the roadway or ground surface 19.

Figure 9:
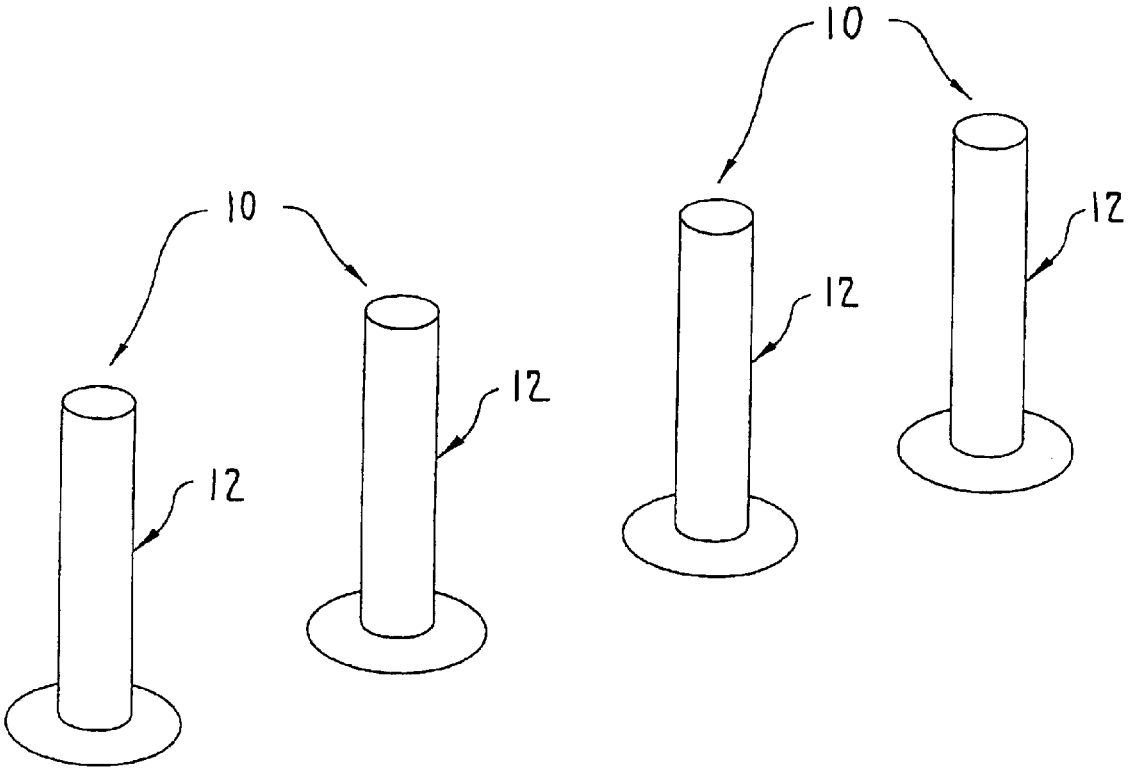
FIG. 9 is a perspective view of a number of pylon arrangements according to the invention installed along a roadway or other area to provide traffic guidance.

In operation, when raising of the pylon or pylon 12 from the lowermost position illustrated in FIG. 3 is desirable or necessary, the appropriate input command is entered into the control board 55A via a remotely-located control panel (not shown) to energize motor 55 and rotate the drive shaft 18. Upon rotation of the drive shaft 18, the linear drive 54 and pylon 12 translate upwardly relative to drive shaft 18. The respective upper and lower switches or sensors 28 and 28A are mounted on inner tube 14 in axial locations which correspond to the axial position of the magnet 50 when the pylon 12 is in the extended and retracted positions, respectively. Once the pylon 12 has reached the upper position wherein the upper surface of hub 43 abuts or is disposed closely adjacent stop blocks 50A and magnet 50 is axially adjacent upper sensor 28, sensor 28 senses magnet 50 and emits a signal to deenergize motor 55 and stop further upward advancement of the pylon 12 relative to shaft 18. Sensor 28 also indicates that the pylon 12 is in the up or fully-extended position. As shown in FIG. 9, a grouping of pylons 12 in their uppermost raised positions can thus be used to restrict travel within certain traffic lanes or areas, whether vehicular traffic or pedestrian traffic. In the illustrated embodiment, the approximate height of the pylon 12 in the up position as measured from ground level 19 is approximately 3 feet. The pylon 12 can then be lowered into the retracted position shown in FIG. 3 by entering the appropriate input command into the control panel to effectively reverse the polarity of the motor 55, which reverses the rotational direction of drive shaft 18 and causes the pylon 12 and drive 54 to traverse downwardly relative to shaft 18. Once the pylon 12 is has reached the down or lower position wherein magnet 50 is axially adjacent lower sensor 28A, sensor 28A senses magnet 50 and emits a signal to deenergize motor 55. Sensor 28A also indicates that the pylon 12 is in the retracted position. As such, a transitional position of the pylon 12 can be detected when no signal is received from either of sensors 28 and 28A.

In the event of a sudden downward driving movement of the upper end of the pylon tube 40 during movement thereof into the upwardly extended position (for example when the pylon 12 is less than about six inches above the top flange 30), for example when a vehicle tire or other object forces the pylon tube 40 downwardly, the linear drive 54 acts as a clutch which decouples the pylon 12 from the drive shaft 18. More specifically, the contact between the roller bearings 64 and 65 of the linear drive 54 and the smooth drive shaft 18 provides a sufficient level of linear thrust required to raise and lower the pylon 12. However, the drive 54 acts as a linear clutch by slipping downwardly on the drive shaft 18 when the pylon 12 is acted upon by an axial load which exceeds a predetermined threshold as determined by the adjusted clamping force of blocks 56, 60 on shaft 18. When this predetermined threshold is exceeded, the pylon 12 breaks free of its positive engagement with the shaft 18 and translates downwardly relative to the shaft 18 until the source of overload is removed. Once the downward force on the pylon 12 is removed, the pylon 12 once again translates up the shaft 18 to its maximum height above the ground surface 19. Thus, damage to the interior components located within the inner tube 14 is avoided, for example, damage to the motor 55 and/or control board 55A within lower compartment 83. Damage to the drive mechanism 17 itself is also avoided.

In one application of the illustrated embodiment, the end loading force applied to the pylon 12 and transmitted through the drive shaft 18 due to an abrupt downward movement of pylon 12 is minimal. In contrast, if such an abrupt axial force is applied to a conventional arrangement utilizing a threaded shaft and screw nut, the shaft and nut can be damaged, in addition to the damage which can be caused by the downward driving of the shaft into the lower end of the cartridge.

Further, for vehicle traffic applications, the pylon tube 40 is preferably constructed of a flexible, yet semi-rigid and durable and resilient material, such as polyethylene plastic. As such, when a lateral force is applied to the pylon tube 40 whether in the fully extended position or when rising from the cartridge 11, the tube 40 will yield under the lateral force and bend sidewardly. When the force is removed, the pylon tube 40 will essentially regain its original upright configuration. In addition, it is also advantageous to provide the pylon tube 40 with a bright color, such as yellow or orange, so that same is easily visible.

The sealing arrangement 33 located at the upper end of the cartridge 11 is also advantageous. Water and debris can severely limit the reliability and operation of a below-ground pylon arrangement, and preventing water and contaminants from entering the interior of the arrangement is thus highly desirable. The flexible seals 35 and 36 as shown in FIGS. 3 and 4 maintain contact with the outer surface of the pylon tube 40 regardless of the position thereof, i.e. whether the pylon tube 40 is in the fully retracted or extended position, or moving between these two positions. The flexible seals 35, 36 significantly minimize intrusion of debris and liquid into the arrangement throughout the life-cycle thereof. However, in time and through normal usage, the seals 35 and 36 wear and the roundness of the pylon tube 40 changes due to repeated collisions with vehicles. Thus, the drainage holes 16 in the inner tube 14 allow the escape of fluid from the upper compartment 82. In addition, the brush or wiper 45 cleans the smooth shaft 18 of any debris during each stroke of the pylon 12, and the lip seal 81 prevents entry of water and debris into the lower compartment 83. In contrast, pylon arrangements utilizing a threaded drive shaft arrangement are prone to jamming during operation due to the accumulation of contaminants on the threads of the drive shaft. Thus, the arrangement according to the invention is more reliable than a threaded drive arrangement in a wet, grit-filled environment.

Variations in road grade are common and to accommodate same, the inner diameters of the upper and lower flanges 30 and 22 of the pylon arrangement 10 are significantly larger than the outer diameter of the pylon tube 14 such that a horizontal gap 91 is defined therebetween. This gap 91 allows for at least some angular and/or axial misalignment between the pylon tube 40 and the flanges 30 and 22. Further, the flexible seals 35, 36 extend over this gap 91 and permit angular misalignment of the tube 40 and the flanges 30 and 22. This arrangement is an improvement over conventional devices in which interference between the top plate and the pylon often prevent the pylon from rising, and cause warping or bending of the top plate due to overloading.

Further, the heating unit 85 is advantageously located within the interior of the pylon tube 40. This arrangement heats the air within the pylon tube 40 so that heat is transferred via conduction through the wall of the plastic pylon tube 40. This heating of the pylon tube 40 itself, combined with the upward thrusting force of the arrangement 10 according to the invention (i.e. in the illustrated embodiment approximately sixty pounds), is sufficient to allow the pylon tube 40 to break through a considerable glazing of ice on the surface 19 of the roadway. Since ice formation at the interface between the pylon tube 40 and the upper flange 30 poses the greatest potential for seizure of the arrangement 10 during harsh weather conditions, the mounting of the heating unit 85 at the top of the drive shaft 18 just below the roadway surface 19 is an optimum location. The actuation of the heating unit 85 is controlled via the control board 55A, and may be controlled with a timer which actuates the heating unit 85 intermittently based upon weather conditions, or as otherwise appropriate. The lighting arrangement 86 which is also mounted within the interior of the pylon tube 40 atop drive shaft 18 and just below the roadway surface 19 illuminates the entire pylon tube 40 when in the fully extended position.

Some applications of the pylon arrangement 10 according to the invention for the control of vehicular traffic include toll collection lanes, weighing stations, parking lots, railroad crossings, reversible traffic lanes, HOV lanes, and tunnel and bridge entrances. For pedestrian applications, the flexible pylon tube 40 may be utilized or can be replaced with a more rigid pylon which could potentially include hooks or supports for handrails, lights or lasers, for example. The arrangement according to the invention can be used to remotely control pedestrian flow in amusement parts, stadiums, tourist and shopping areas by controlling groups of pylon arrangements. When use of the pylons is unnecessary, the pylons are unobtrusively stored beneath ground level.

It will be appreciated that the linear drive 54 disclosed herein is only one example of a preferred commercially available product sold under the name "ZERO-MAX" which may be utilized according to the invention. Other types of linear drives which may conceivably be utilized in accordance with the invention are disclosed in U.S. Pat. Nos. 4,411,166 and 3,272,021, which are hereby incorporated by reference herein.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A barrier arrangement for the control of traffic including at least one pylon assembly comprising:

an elongate post mounted in a generally vertical manner within the ground and telescopingly movable relative thereto between an uppermost position wherein said post extends above the ground surface and a lowermost position wherein said post is disposed substantially completely beneath the ground; and a remotely-actuable drive mechanism for moving said post between said uppermost and lowermost positions, said drive mechanism including an elongate and generally vertically oriented rotatable drive shaft, and a drive member coupled to said drive shaft and fixed to said post, wherein rotation of said drive shaft causes displacement of said drive member and said post relative to and along said drive shaft to move said post into one of said uppermost and lowermost positions, wherein an abrupt and downwardly directed axial force applied to an upper end of said post during upward movement thereof decouples said drive member from said drive shaft.

2. The arrangement of claim 1 wherein said pylon assembly includes a housing disposed in a generally vertical manner within the ground, and said post is disposed generally coaxially within said housing and is telescopingly moveable relative thereto.

3. The arrangement of claim 2 wherein said drive mechanism includes an electric motor disposed adjacent a lower end of said housing and in driving engagement with said drive shaft.

4. The arrangement of claim 1 wherein said drive shaft is configured to permit downward movement of said drive member relative thereto upon application of the downwardly directed force.

5. The arrangement of claim 1 wherein said drive member is disposed in clamping engagement with said drive shaft, and said drive member is adjustable to permit variation of the clamping force by said drive member on said drive shaft.

6. The arrangement of claim 1 wherein said post is constructed of flexible material such that when a lateral force is applied to said post when in the uppermost position or during upward movement thereof, said post bends sidewardly and then returns to an upright position when the source of the lateral force is removed.

7. The arrangement of claim 1 wherein said drive shaft has an outer surface and said drive member is disposed in contact with said outer surface, said outer surface being smooth to permit downward slippage of said drive ember and said post relative to said drive shaft upon application of the downwardly directed force.

8. The arrangement of claim 1 including a plurality of said pylon assemblies arranged in side-by-side, spaced relation with one another in a predetermined configuration to provide traffic guidance in a selected location.

9. A barrier arrangement for the control of traffic comprising:

a traffic-controlling post disposed in a generally upright manner within the ground, said post being reciprocatingly movable between an upper position wherein said post extends above the surface of the ground and a lower position wherein the post is disposed substantially beneath the ground; and a remotely-actuable drive arrangement for moving said post into the upper and lower positions, said drive arrangement including a rotatable drive shaft and an actuator member coupled with said drive shaft for converting rotary motion thereof into linear motion to move said post into said upper or lower position, wherein a generally downwardly directed force imposed on an upper end of said post during upward movement thereof causes said actuator member to decouple from said drive shaft and allow lowering of said post.

10. The arrangement of claim 9 wherein said actuator member is coupled to said drive shaft so as to translate upwardly or downwardly relative to and along said drive shaft depending upon the rotational direction thereof to raise said post into the upper position or lower said post into the lower position.

11. The arrangement of claim 9 wherein said actuator member clampingly engages said drive shaft with a predetermined clamping force and when the downwardly directed force exceeds a predetermined value as determined by said predetermined clamping force, said post and said actuator member break free of positive engagement with said drive shaft and translate downwardly relative thereto until the source of the force is removed.

12. The arrangement of claim 9 wherein said actuator clampingly engages said drive shaft, and when the downwardly directed force exceeds the clamping force of said actuator on said drive shaft, said actuator and said post decouple from said drive shaft.

13. The arrangement of claim 9 wherein said actuator member includes a pair of clamping members disposed in opposed relation with one another on opposite sides of said drive shaft, said clamping members being fastened to one another in an adjustable manner to permit variation of the clamping force of said actuator member on said drive shaft.

14. The arrangement of claim 9 wherein said drive shaft is threadless.

15. A method of operating a barrier arrangement for controlling traffic including at least one pylon assembly, said method comprising:

providing a pylon assembly with an elongate post mounted in a generally vertical manner within the ground and telescopingly movable relative thereto between an uppermost position wherein the post extends above the ground surface for controlling traffic and a lowermost position wherein the post is disposed substantially beneath the ground, a remotely-actuable drive mechanism for moving said post between the uppermost and lowermost positions and having an elongate and generally vertically oriented rotatable drive shaft and a drive member coupled to the drive shaft and fixed to the post;

remotely actuating the drive mechanism and rotating the drive shaft to cause displacement of the drive member and the post relative to and along the drive shaft to move the post into one of the uppermost and lowermost positions;

applying an abrupt and downwardly directed axial force to the upper end of the post during upward movement thereof; and upon application of the downwardly directed axial force, decoupling the drive member from the drive shaft to prevent damage to the pylon assembly.

16. The method of claim 15 including applying a downwardly directed axial force to the upper end of the pylon as same emerges from the ground.

17. The method of claim 15 including applying a downwardly directed axial force to the upper end of the pylon during upward movement thereof with a vehicle wheel.

* * * * *